United States Patent [19]

Perkins

[11] 4,162,691

[45] Jul. 31, 1979

[54] TUBULAR VALVE DEVICE

[75] Inventor: Lee E. Perkins, Houma, La.

[73] Assignee: Kajan Specialty Co., Inc., Houma, La.

[21] Appl. No.: 834,283

[22] Filed: Sep. 19, 1977

[51] Int. Cl.[2] ..... F16K 11/10

[52] U.S. Cl. ..... 137/613; 251/344; 251/347; 251/348; 166/301; 166/312; 166/323

[58] Field of Search ..... 251/344, 347, 348, 76; 166/99, 332, 333, 344; 137/613

[56] References Cited

U.S. PATENT DOCUMENTS

| | | | |
|---|---|---|---|
| 2,344,121 | 3/1944 | Bassinger | 166/333 |
| 3,094,306 | 6/1963 | Conrad | 251/344 X |
| 3,376,936 | 4/1966 | Tomlin | 166/334 |

*Primary Examiner*—Harold W. Weakley

*Attorney, Agent, or Firm*—Bill B. Berryhill

[57] ABSTRACT

Valve apparatus may comprise a first tubular member; a second tubular member telescopically engaging the first tubular member for axial movement between a retracted position and an extended position, the first and second tubular members forming flow passage through which fluid communication may be established between the opposite ends of the apparatus; ports through the walls of one of the tubular members by which fluid communication may be established between the flow passage and the exterior of the valve apparatus; and a closure assembly carried by one of the tubular members for selectively opening and closing the ports to permit or prevent fluid communication with the exterior of the apparatus. Methods of using the valve apparatus in remedial oil and/or gas well operations are also disclosed.

13 Claims, 6 Drawing Figures

TUBULAR VALVE DEVICE

BACKGROUND OF THE INVENTION

1. Field of the Invention

The present invention pertains to valves and methods of use thereof. Specifically, it pertains to fluid circulating valves particularly useful in well drilling operations for recovering lost equipment or freeing equipment which may be lodged within the well.

2. Description of the Prior Art

In the drilling and production of wells, particularly oil and gas wells, a portion of the drill string or tools, such as a drill bit, may become stuck or actually lost in the well bore. If a tool is twisted off or lost in the well bore, it then becomes necessary to perform what is sometimes called a "fishing" operation to retrieve the lost tool. A fishing string may comprise an overshot tool and possibly other tools such as drain subs, bumper jars, hydraulic or mechanical jars, drill collars, etc. connected to the lower end of a pipe string. The drain sub in a fishing string is required so that the pipe may drain as the lost object or "fish" is recovered from the hole. However, drain subs of the prior art do not allow washing operations which might be desirable to remove mud or other debris which has settled on the top of or around the lost tool.

Another problem associated with fishing operations is the assurance that the lost tool has been engaged by the overshot tool. With fishing methods and equipment of the prior art, particularly when the lost tool or fish is of small size and weight, the operator cannot determine if the lost tool has been engaged. On many occasions, it has been discovered, after pulling the fishing string out of the well bore, that the lost tool is still in the well bore.

In washover operations, a wash pipe with associated tools, such as a washover shoe, wash pipe bushing, safety joints, bumper jar, hydraulic or mechanical jars, drill collars, and the like, may be connected to the bottom of a pipe string which runs to the surface. The washover assembly is normally lowered to the lodged item so that the washover pipe surrounds the lodged item. Then, washing fluid is circulated through the pipe string in an attempt to wash away the mud or other debris which may be holding the stuck equipment in the well bore. However, the necessary large diameter of the wash pipe which is required to surround the lost drill pipe, drill collars, or other equipment, creates problems due to the small clearances between the well bore and the outside diameter of the wash pipe. This small clearance may cause pressure build-up as the pipe string is lowered into the well bore, increasing the time required for such operations and sometimes causing permanent damage to the formation surrounding the well bore. This small clearance also creates a problem when the pipe string is removed from the well bore since a partial vacuum may be created below the wash pipe creating a condition sometimes referred to as "swabbing" which may result in a well blowout.

SUMMARY OF THE INVENTION

The present invention provides a pressure circulating valve which is specially useful in overcoming the previously discussed problems of fishing and washing operations of the prior art. In a preferred embodiment, the valve may comprise: a tubular housing; a tubular mandrel, telescopically received by the housing for axial movement between a retracted position and an extended position. The housing and mandrel form a flow passage through which fluid communication may be established between the opposite ends of the valve. Ports are provided through the walls of the housing by which fluid communication may also be established between the flow passage and the exterior of the housing. A sleeve member is carried by the housing for selectively preventing or permitting the flow communication with the exterior of the housing.

In its retracted position, the ports of the valve are closed whereas in the extended position, the ports are normally open. However, due to differential pressure areas provided on the sleeve, the valve may be maintained in closed position from the retracted to the extended positions, if a pressure is applied to the valve in its retracted position. This feature is extremely useful in fishing and washing operations, such as the ones described hereinabove. Moreover, with the pressure circulating valve of the present invention, many of the problems associated with the prior art fishing and washing operations are eliminated.

In fishing operations, the pressure circulating valve of the present invention may be attached in the fishing string just above an overshot tool. The overshot may then be lowered into the well bore and engaged with the fish or lost tool, while fluid is circulated under pressure through the pipe string. Upon engagement with the tool, the pressure circulating valve is forced to its retracted position by the weight of the string, closing its ports and causing an increase in pressure in the string. Then the string may be lifted and if increased pressure is maintained, the operator will know that the fish has been properly engaged before removing the string from the well. If the fish has not been properly engaged, the pressure will drop and the operator will know that another attempt should be made to engage the fish or lost tool.

In washing operations, the pressure-circulating valve of the present invention prevents undue pressure increase as the string is being lowered into the well by allowing fluid circulation between the pipe string and the annulus surrounding it. Likewise, swabbing is prevented on removal of the string by allowing the fluid in the annulus surrounding the string to be displaced through the valve for dumping into the well bore. In addition, the valve may be closed during actual washing operations so that full washing fluid flow may be obtained around the stuck or lodged item.

Thus, use of the valve apparatus of the present invention can eliminate many of the problems associated with the prior art. In addition, the valve is cheaply manufactured and easily operated. Many other objects and advantages of the invention will become apparent from reading the description which follows in conjunction with the accompanying drawings.

DESCRIPTION OF PREFERRED EMBODIMENTS

Figure 1:
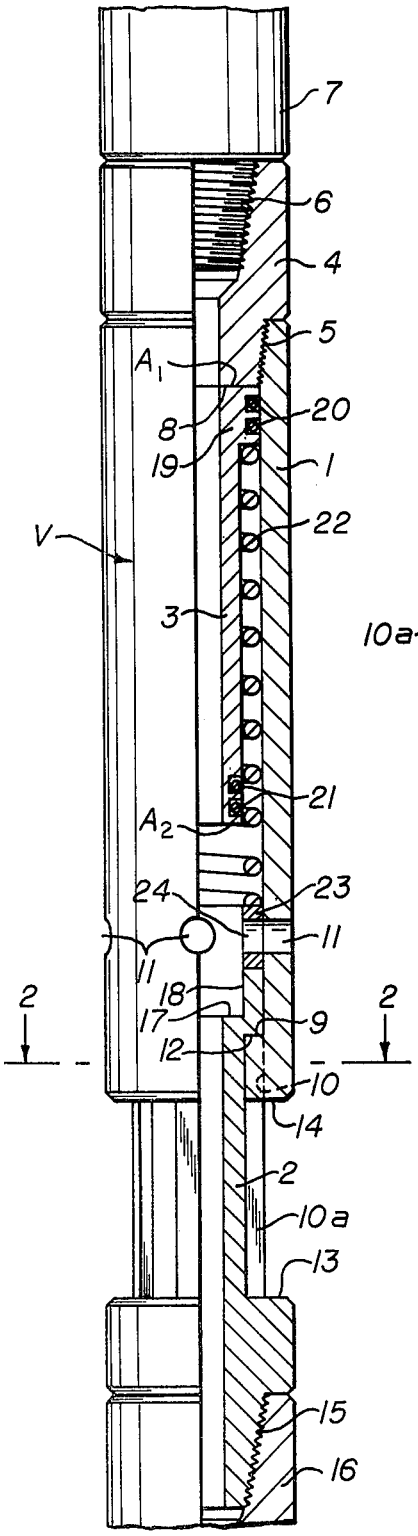
FIG. 1 is a longitudinal quarter-sectional view of a circulating valve, according to a preferred embodiment of the invention, showing the valve in an extended open position.
Figure 2:
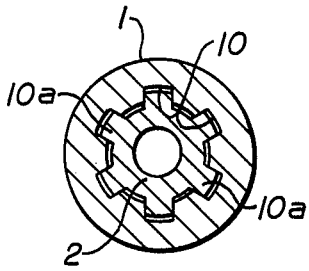
FIG. 2 is a horizontal cross-sectional view, taken along lines 2—2 of FIG. 1, of the valve of the present invention.
Figure 3:
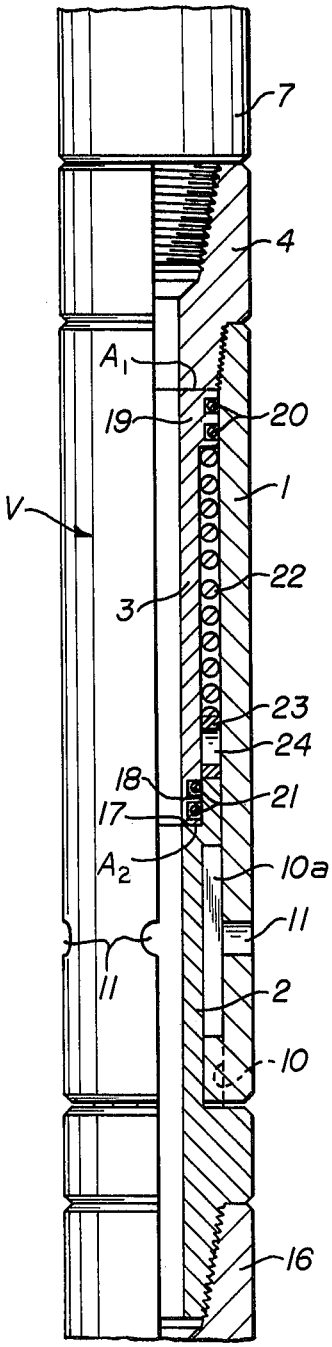
FIG. 3 is a longitudinal quarter-sectional view of the valve of the present invention, similar to FIG. 1, but showing the valve in a retracted, closed position.
Figure 4:
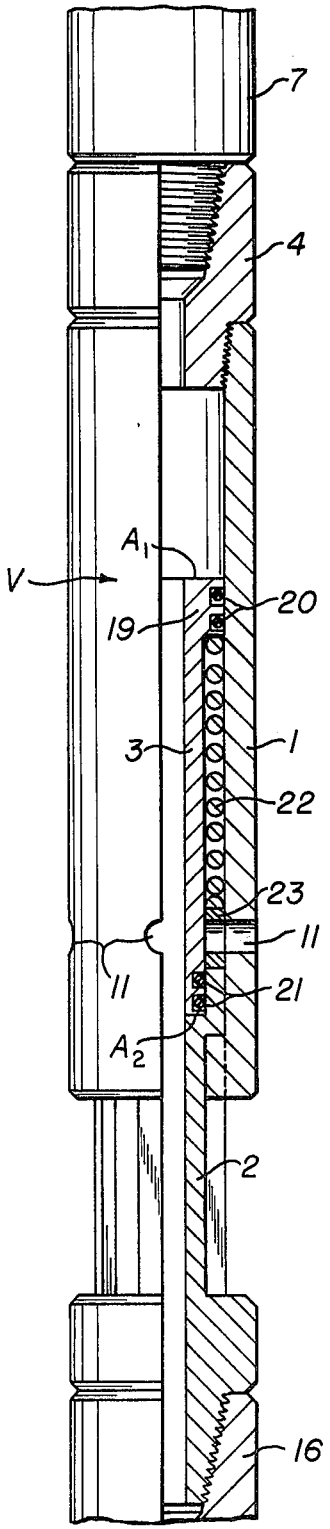
FIG. 4 is a longitudinal quarter-sectional view of the valve of the present invention, showing the valve in an extended and closed position.

Referring first to FIGS. 1–4, there is shown a pressure-circulating valve V according to a preferred embodiment of the invention. The valve may comprise a tubular housing 1, a tubular mandrel 2 telescopically received by the housing 1 for axial movement between a retracted position, as shown in FIG. 3, and an extended position as shown in FIGS. 1 and 4; and a tubular sleeve member 3 disposed within the housing 1 for limited axial movement therein.

The tubular housing 1 may be provided at its upper end with a coupling sub 4 which is connected to the housing 1 by threads 5 or any other suitable means. The sub 4 is internally threaded at 6 for threaded engagement with a section of drill pipe 7 or any other component of a pipe string as will be more fully understood hereafter. The sub 4 also provides an annular shoulder 8 which limits the movement of sleeve 3 in that direction.

The opposite end of housing 1 is provided with an internal shoulder 9 through which may be cut several longitudinal splineways 10 for cooperation with splines **10*a* of mandrel 2 as will be more fully described hereafter. Just above the shoulder 9, housing 1 is provided with a plurality of radial ports 11 which provide fluid communication between the exterior of housing 1 and the longitudinal flow passage formed by housing 1 and mandrel 2**.

The tubular mandrel 2 is telescopically received by the housing 1 for limited axial movement with respect to housing 1. However, relative rotational movement between the mandrel 2 and housing 1 is prevented by cooperation of longitudinal splines **10*a* on the mandrel 2 with corresponding splineways 10 of the housing 1. This permits torque to be transmitted from the above pipe string through housing 1 and mandrel 2 to equipment below the valve V. Axial movement of the mandrel 2 toward an extended position is limited by the engagement of mandrel shoulder 12 with the housing shoulder 9; whereas axial movement toward the retracted position is limited by the engagement of mandrel shoulder 13 with the lower end 14 of housing 1**.

The lower end of the mandrel 2 may be provided with a threaded pin portion 15 for engagement with the box portion of a pipe joint 16 or any other component of a pipe string in which the valve V may be used, as will be more fully explained hereafter.

The upper end of the mandrel 2 is counterbored to provide an upwardly facing annular shoulder 17, the purpose of which is to limit axial movement of the sleeve 3. The counterbore also provides a smooth, cylindrical sealing surface 18, the full purpose of which will be more fully understood hereafter. The sleeve member 3 is cylindrical but provided with an external radial rib or flange portion 19 in which is carried annular seal members 20 for sliding and sealing engagement with the internal surface of the housing 1. The lower exterior of the sleeve member 3 is also provided with annular seal members 21 for sliding and sealing engagement with the cyindrical sealing surface 18 of mandrel 2, as best seen in FIGS. 3 and 4. As can be easily understood, the upward movement of sleeve 3 is limited by housing shoulder 8 whereas the lower movement of sleeve 3 is limited by the annular shoulder 17 of mandrel 2.

Mounted between the upper end of mandrel 2 and the rib portion 19 of sleeve 3 is biasing means which may include a helically wound spring 22 and a ring 23 against which the lower end of the spring 22 rests. The ring 23 may be provided with radial ports 24 which, when in registration with the ports 11 of housing 1, do not impede fluid communication between the exterior of the housing 1 and the flow passage formed by the housing 1 and mandrel 2. It is readily understood that the spring 22 biases the sleeve member 3 toward the shoulder 8 of the housing 1.

It should be noted at this point that the diameter of sleeve member seals 20 is greater than the diameter of the seals 21 at the opposite end. Thus, when the sleeve member is in a position sealingly engaging both the housing 1 and the mandrel 2, as shown in FIGS. 3 and 4, the annular surface area $A_1$ subjected to pressure within the valve V is greater than the annular surface $A_2$ at the opposite end of the sleeve member 3. The force tending to move the sleeve member 3 in a downwardly direction against the bias of spring member 22 in such a situation can be determined by the formula: $F=P(A_1-A_2)$; where F is the force and P is the pressure existing in the flow passage formed by housing 1 and mandrel 2. Thus, it can be seen that with a sufficient pressure P, the biasing force of spring 22 can be overcome.

To more fully understand the operation of the pressure circulating valve V, reference is first made to FIG. 1. In this position, the mandrel 2 is fully extended and the sleeve member 3 is biased upwardly against the shoulder 8 via spring member 22. As can be seen, the radial ports 11 are unblocked or open. Thus, fluid may flow through the flow passage provided by housing 1 and mandrel 2 and fluid communication is also freely established between the flow passage and the exterior of the housing 1 through the ports 11.

In FIG. 3, the valve V is illustrated in the mandrel retracted position. To obtain this position, enough weight or axial force must be applied to one end of the valve V to overcome the biasing force of spring 22. In the retracted position of FIG. 3, it will be noted that the sleeve member 3 sealingly engages the housing 1 at seals 20 and sealingly engages mandrel 2 at seals 21, effectively blocking or closing the ports 11 and preventing fluid communication between the flow passage of the valve V and the exterior of housing 2. This position is strictly dependent upon weight or forces applied to the ends of the valve V and is not affected by pressures within the valve. However, if the pressure P within the valve is now raised to a sufficient level, the valve ports 11 can remain blocked or closed even though the mandrel 2 is moved to its extended position. Such a condition is shown in FIG. 4.

As illustrated in FIG. 4, sufficient pressure P exists in the flow passage of the valve V acting against a differential area $A_1$–$A_2$ to overcome the biasing force of spring 22. Thus, the sleeve member 3 moves from its upper terminal position to its lower terminal position still sealingly engaging the cylindrical surface 18 of mandrel 2 and slidingly and sealingly engaging the internal wall of housing 1. Of course, the ports 11 remain blocked or closed preventing fluid communication between the valve flow passage and the exterior of the housing 1. If the pressure within the valve flow passage now drops below a predetermined level, the force resulting from the differential areas $A_1$–$A_2$ will not be sufficient to overcome the force of spring 22 and the sleeve member 3 will return to the position of FIG. 1, again unblocking and opening the ports 11. Thus, one can see that the valve V of the present invention has three distinct and effective positions: an extended and open circulating position (FIG. 1); a retracted and closed circulating position (FIG. 3); and an extended and closed circulating position (FIG. 4).

Figure 5:
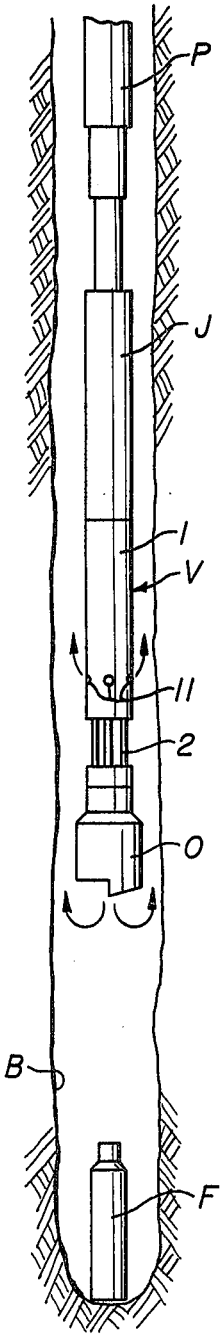
FIG. 5 is a generally diagrammatic view of the bottom of a well bore, illustrating a method of using the valve of the present invention in recovering equipment lost in the well bore.

Referring now to FIG. 5, one method of utilizing the circulating valve of the present invention for recovering equipment lost in the bottom of a well bore will be described. In FIG. 5, a piece of lost equipment, sometimes referred to as a "fish" F is shown lost in the bottom of a well bore B. Such equipment may be lost by breakage of or unscrewing from the pipe string to which the lost equipment F was attached. There can be several reasons or causes for losing a piece of equipment. To recover the fish F, a recovery assembly may be attached to the end of a pipe string P and lowered into the wellbore B. The recovery assembly may include a conventional overshot tool O, a pressure circulating valve V, according to the valve of the present invention described hereinabove, conventional jars, drill collars or other tools used in fishing operations.

The recovery assembly and pipe string are lowered to a point just above the lodged or lost equipment F. Then fluid is pumped from the surface of the well (not shown) down through the pipe string P and the recovery assembly, including the pressure circulating valve V. At this point, the pressure circulating valve V is in the extended open position illustrated in FIG. 1. Thus, the fluid pumped through the pipe string P may exit both through the overshot O and ports 11 of the valve V for return to the surface through the annulus surrounding the pipe string P.

As fluid continues to circulate, the recovery assembly and pipe string P are further lowered until the overshot O contacts and hopefully properly engages the lodged or lost equipment F. The pipe string P is further lowered and enough weight is applied to cause the pressure circulating valve V to move to the retracted and closed circulating position illustrated in FIG. 3. Thus, the ports 11 are closed and all fluids being pumped through the flow passage of the valve V must now exit through the overshot O. In the event that mud or debris has settled around the lost or lodged equipment F, the closing of the circulating ports 11 will cause a washing action out of the bottom of the overshot O clearing away debris and mud from the lost equipment F until the overshot can properly engage the lodged equipment. If the overshot is properly over and engaging the lost equipment F, flow will be materially blocked and the circulating pressure in the pipe string P will be increased, and can be detected at the surface of the well.

Next, the pipe string P is partially raised to determine if the lost equipment F has been properly engaged by the overshot O. If the lost equipment F is properly engaged, there will be no appreciable decrease in circulating pressure indicating to the operator at the surface that the fish F is prophrly engaged and allowing he operator to raise the pipe string for removal of the recovery assembly and the lost equipment F. As the pipe string and lost equipment is raised, the valve will again assume an extended position. But, if the lost equipment is properly engaged and the increased circulating pressure maintained, the differential pressure areas of the valve sleeve will keep the sleeve in a closed position and the valve will be in the position of FIG. 4.

If on initial raising of the pipe string P, there is a material decrease in the pressure of the circulating fluid therein, this will indicate that the overshot O has not properly engaged the lost equipment or fish F. If this be the case, the pipe string P will again be lowered and the steps previously described will be repeated until the lost equipment or fish F is properly engaged, as indicated by maintaining circulating pressure, and finally removed.

Thus, it is seen that use of the valve V of the present invention in such a fishing operation can greatly simplify operations and positively indicate whether or not the lost equipment F has been properly engaged for removal. As previously mentioned, no such method is known in the prior art. In fact, with methods of the prior art, it may be necessary to complete remove the pipe string and recovery assembly to determine whether or not the lost equipment has been engaged.

Figure 6:
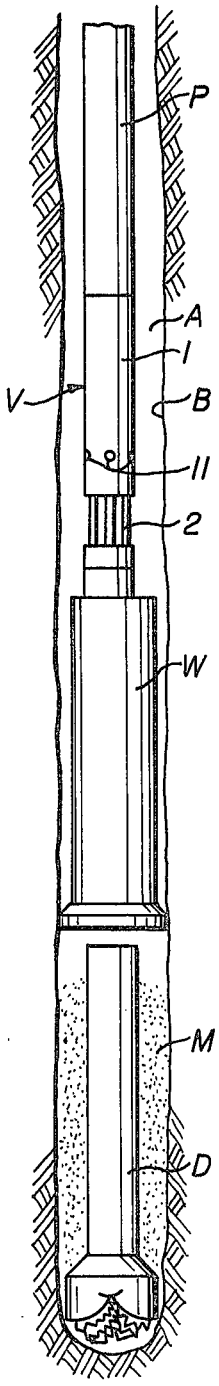
FIG. 6 is a generally diagrammatic view of the bottom of a well bore illustrating use of the valve of the present invention in a washing operation.

Referring now to FIG. 6, another method of utilizing the valve of the present invention will be described. This method involves what is sometimes referred to as a washing operation. Washing operations are sometimes necessitated when sections of drill pipe may become stuck in the well bore due to surrounding mud or debris or wedging in the well bore. In such cases, the mud, debris or other material surrounding the stuck pipe may be washed away by lowering a larger diameter wash pipe down around the stuck pipe and circulating a washing fluid through the annulus formed between the stuck pipe and the wash pipe. As previously mentioned, with the methods of the prior art, the large diameter of the wash pipe may create problems both during lowering into the well and removal therefrom. Due to the small clearance between the wash pipe and the well bore, pressure may build up as the wash pipe is lowered into the well causing damage to the surrounding formations. On removal from the well, a partial vacuum may be created causing a condition known as "swabbing," which may prematurely bring the well in or result in a dangerous and expensive blowout. These problems are eliminated by use of the valve of the present invention.

As shown in FIG. 6, a section of drill pipe D is illustrated as being stuck in the well bore B by surrounding mud, debris or other materials M. To wash the materials M away releasing the drill pipe D, a washing assembly is attached to the lower end of a pipe string P and lowered to a point near the stuck drill pipe D. The washing assembly may include a wash pipe W, the inside diameter of which is greater than the outside diameter of the drill pipe D. The washing assembly also includes a valve V according to the present invention, and may include other conventional well tools such as safety joints, hydraulic or mechanical jars, drill collars, and the like.

As the pipe string P and the washing assembly is first lowered into the well bore B, the valve V is in the extended and unblocked circulating position of FIG. 1. Thus, any mud or other fluids existing in well bore B may be displaced upwardly through the pipe string P and also through the annulus A via the ports 11 of the valve V. This keeps the pressure from building up below the washing assembly and prevents unnecessary pressure damage to the surrounding formations.

The pipe string P is further lowered until the wash pipe W surrounds the drill pipe D and sufficiently rests against material M or a portion of the drill pipe D to apply enough force to foreshorten or move the valve V to the retracted and closed circulating position of FIG. 3. Then, washing fluid is pumped though the pipe string P, valve V and wash pipe W for washing away the unwanted materials M surrounding the drill pipe D. Since the valve V is in the retracted, closed position of FIG. 3, all of the wash fluid is directed through the wash pipe W creating the necessary flow for washing away the unwanted materials M. If the washing fluid is maintained at a sufficient level the pipe string P and wash pipe W can be raised and lowered as desired while washing operations continue without opening the ports 11, although the valve may be in an extended position such as shown in FIG. 4.

After washing has been completed, the pipe string P and washing assembly will be raised for removal from the well. As these items are raised, the valve V will again assume an extended position. Since the flow of washing fluid has ceased at this point, there will not be sufficient pressure to maintain the valve sleeve 3 in its closed position. Thus, the sleeve 3 will assume the unblocked or open position of FIG. 1. With the valve V in the extended and unblocked position of FIG. 1, any fluids remaining in the annulus A are free to circulate through the ports 11 into the flow passage of the valve V for exit through the wash pipe W. This prevents creation of a partial vacuum below the wash pipe W and assures that swabbing and resulting blowouts will be avoided.

The foregoing fishing and washing operations are two unique methods made available by the circulating valve of the present invention. Other methods and uses of the valve will be apparent to those skilled in the art. Although a preferred embodiment of the valve of the present invention has been fully described herein, many variations of it will also be apparent to those skilled in the art. Therefore, it is intended that the scope of the invention be limited only by the claims which follow.

I claim:

1. Valve apparatus comprising:

a first tubular member;

a second tubular member telescopically engaging said first tubular member for axial movement between a retracted position and an extended position, said first and second tubular members forming a flow passage through which fluid communication may be established between opposite ends of said apparatus;

port means through the walls of one of said tubular members by which fluid communication may be established between said flow passage and the exterior of said apparatus;

closure means carried by one of said tubular members for selectively opening and closing said port means to permit or prevent said fluid communication with the exterior of said apparatus when said second tubular member is in said extended position; and biasing means biasing said closure means toward an opened position.

2. Valve apparatus as set forth in claim 1 in which said closure means is provided with surface areas exposed to the pressure environment of said flow passage responsive to a predetermined pressure within said flow passage for overcoming said biasing means to move said closure means toward a closed position.

3. Valve apparatus as set forth in claim 1 in which said closure means includes differential pressure areas thereon responsive to a predetermined pressure level within said flow passage when said second tubular member is in said retracted position to overcome said biasing means and hold said closure means closed when said second tubular member is in said extended position.

4. Valve apparatus as set forth in claim 1 in which said first and second tubular members are provided with cooperating rotation prevention means permitting said axial movement of said second tubular member but preventing relative rotation thereof relative to said first tubular member.

5. Valve apparatus as set forth in claim 4 in which said rotation prevention means comprises splines on one of said first and second tubular members and cooperating splineways on the other.

6. Valve apparatus as set forth in claim 1 in which said closure means comprises a tubular sleeve member disposed within one of said tubular members for limited axial movement therein.

7. Valve apparatus as set forth in claim 6 in which said sleeve member is provided with a first annular seal means for slidingly and sealingly engaging the interior of said one of said tubular members and second annular seal means for sealingly engaging the other of said tubular members when closing said port means.

8. Valve apparatus as set forth in claim 7 in which the diameter of said first seal means is greater than the diameter of said second seal means.

9. Valve apparatus as set forth in claim 7 in which said sleeve member is terminated at its opposite ends by annular surfaces, the annular surface nearest said first seal means being greater than the annular surface nearest said second seal means.

10. Valve apparatus comprising:

tubular housing means;

tubular mandrel means telescopically received by said housing means for axial movement between a retracted position and an extended position, said housing and mandrel means forming a flow passage through which fluid communication may be established between opposite ends of said apparatus;

port means through the walls of said housing means by which fluid communication may be established between said flow passage and the exterior of said housing means;

sleeve means carried by said housing means for selectively preventing or permitting said flow communication with the exterior of said housing means, said sleeve means including first annular seal means sealingly engageable with said housing means and second annular seal means engageable with said mandrel means for preventing said flow communication with the exterior of said housing means; and biasing means engaging and biasing said sleeve means in a direction away from said mandrel means.

11. Valve apparatus as set forth in claim 10 in which said sleeve means is confined between a first shoulder on said housing means and a second shoulder on said mandrel means, said first and second shoulders preventing axial movement of said sleeve means when said mandrel means is in said retracted position and maintaining said sleeve means in a position to prevent said flow communication with said exterior of said housing means.

12. Valve apparatus as set forth in claim 11 in which said sleeve means is disposed for limited axial movement between said first and second shoulders when said mandrel means is in said extended position, said sleeve means permitting said flow communication with the exterior of said housing means when engaging said first shoulder but preventing said flow communication when engaging said second shoulder.

13. Valve apparatus as set forth in claim 11 in which said sleeve means terminates in a first annular surface area at one end and a second smaller annular surface area at the opposite end, the differential area of said first and second surface areas being sufficient when subjected to a preselected pressure level within said flow passage, while said second annular seal means engages said mandrel means, to overcome said biasing means, preventing said sleeve means from disengaging said second shoulder.

* * * * *